United States Patent [19]

Martin

[11] 4,376,238

[45] Mar. 8, 1983

[54] ELECTRICAL DEVICES

[75] Inventor: Sidney H. Martin, Mellor, England

[73] Assignee: International Computers Limited, London, England

[21] Appl. No.: 242,700

[22] Filed: Mar. 11, 1981

[30] Foreign Application Priority Data

Mar. 12, 1980 [GB] United Kingdom ..... 8008279

[51] Int. Cl.[3] ..... H01H 13/52

[52] U.S. Cl. ..... 200/159 B; 200/1 B; 200/5 A

[58] Field of Search ..... 200/159 B, 83 N, 1 B, 200/5 A

[56] References Cited

U.S. PATENT DOCUMENTS

| | | | |
|---|---|---|---|
| 3,898,421 | 8/1975 | Suzumura | 200/159 B |
| 3,917,917 | 11/1975 | Murata | 200/83 N |
| 3,996,429 | 12/1976 | Chu et al. | 200/5 A |
| 4,084,071 | 4/1978 | Smith | 200/5 A |

FOREIGN PATENT DOCUMENTS

| | | | |
|---|---|---|---|
| 2284177 | 4/1976 | France | 200/159 B |
| 1441765 | 7/1976 | United Kingdom . | |
| 2054268 | 9/1981 | United Kingdom | 200/159 B |

*Primary Examiner*—John W. Shepperd

*Attorney, Agent, or Firm*—Hane, Roberts, Spiecens & Cohen

[57] ABSTRACT

A membrane switch assembly in which portions of a membrane 14 mounted on a base member 11 are belled-outwardly to provide cavities 15, which are positioned so as to overly the location at which conductors 21, 22 are to be connected. The formation of each belled out portion is such that each portion carries electrical contactor means 16, 20 and such that the portion has a circumscribing region 18 which on compression of the portion to cause switch operation allows the membrane 14 to collapse at this region before the membrane is fully compressed.

2 Claims, 2 Drawing Figures

ELECTRICAL DEVICES

BACKGROUND OF THE INVENTION

The present invention relates to switching devices for controlling the passage of electrical signals and in particular to such switches incorporating an elastomeric membrane.

THE PRIOR ART IN GENERAL

Various forms of switches of this kind have previously been proposed, as will be described, and it has been found that it is possible for an operator to generate unwanted signals or to produce distorted signals when using switches of this kind. It is accordingly an object of the present invention to provide such a switch having a structure less liable to produce such faults in operation.

SUMMARIES OF THE INVENTION

According to the present invention there is provided a switch assembly including a base member, at least one pair of conductors provided upon the base member and which are to be electrically connected, an elastomeric membrane extending over the base member, the membrane having at least one portion belled outwardly away from the base member to define a cavity beneath the membrane and being so positioned as to overly at least two separate pairs of conductors to be electrically connected, each said belled out portion of the membrane having a circumscribing region of such characteristics that on exerting pressure on the portion to collapse said portion towards the base member, said circumscribing region is first to collapse, each said portion also including first and second conductive contactor elements positioned as to be electrically connectable with the first and second pairs of the electrical conductor pairs and so located relative to the circumscribing region that on exerting pressure upon the membrane to collapse said portion towards the base member, said first and second conductive contactor contact elements are caused successively to contact the associated first and second pairs of conductors.

BRIEF DESCRIPTION OF THE DRAWINGS

An embodiment of the present invention will now be described, by way of example, with reference to the accompanying drawing, in which.

DESCRIPTION OF A KNOWN EMBODIMENT

Figure 1:
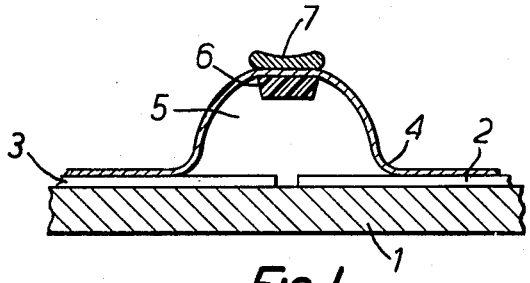
FIG. 1. PRIOR ART
FIG. 1 shows a sectional view of a switching device of known form.

Referring now to FIG. 1, a switching device is formed on a base member 1 of insulating material carrying a pair of adjacent electrical conductors 2,3. Typically, such a structure is formed as a printed circuit arrangement in which the conductors 2,3 are bonded to the base member.

A membrane 4 is laid over the arrangement of conductors 2,3 and is formed belled outwardly to provide a cavity 5, the membrane 4 being positioned relative to the base member 1 so that the cavity 5 is centred over the conductors 2,3 at the point where contact is required to be made between the conductors 2,3.

In practice, the base member 1 would usually include a number of conductors and their respective required contact positions would form a pattern over the member, the disposition of these positions corresponding, for example, to the keys of, say, a typewriter. The membrane 4 would carry a corresponding pattern of belled out portions providing the cavities 5, which are formed as concave hollows in one side of the membrane 4 to produce corresponding domes, or raised portions on the other. The membrane 4 would then be clamped, or, preferably stuck, to the base member 1 and its conductors 2,3.

In the simplest case, a conductive element 6, for example, formed from a conductive elastomer, is secured within the, or each, cavity 5 in alignment with the conductors 2,3. A finger pressure-pad 7 located outside the cavity is provided above the conductive element 6. Thus, it will be appreciated that if finger pressure is applied to the pad 7, the wall of the cavity 5 will deform, so that the conductive element is moved towards the base member from the position shown in the drawing, the element 6 will ultimately be able to bridge the gap between the contacts 2 and 3, thereby allowing an electrical condition carried by one of these contacts to be connected to the other. If necessary, a small hole may be provided in the membrane, the hole communicating with the cavity 5, to avoid a build-up of air pressure within the cavity 5 sufficient to hinder the operation of the switch thus formed. In more complex arrangements, membrane switches of this general kind may be used in association with keyboards in which finger-operated keys are separately supported, provided that some mechanical coupling is provided to act on the appropriate cavity 5 as the result of depression of the corresponding key.

Problems have arisen during use of switches of the kinds referred to above, in particular when they are used in conjunction with electronic apparatus as input-signal keys of a manually operated keyboard, for example. One such problem is concerned with an effect which may be termed "bounce" and occurs if, say, the key is smartly tapped, so that in operation of the switch, the element 6 first makes a fleeting contact with the conductors 2, 3 and then momentarily breaks the connection so made until a firmer pressure is applied. Because of the extremely rapid response of electronic circuits, such an operation may be registered by such circuits as a double actuation of the key, when only a single actuation is intended.

DESCRIPTION OF A PREFERRED EMBODIMENT

Figure 2:
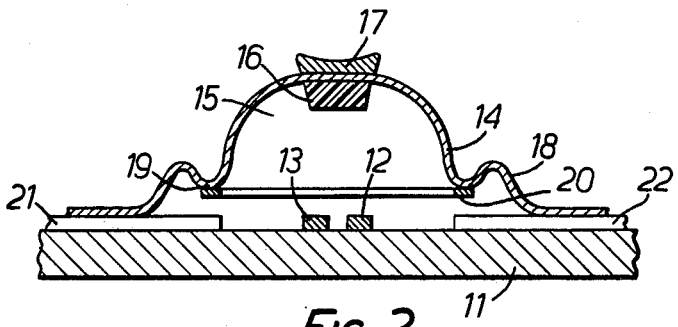
FIG. 2 shows in section, a modified form of switching device according to the invention.

An improved form of membrane switch of this kind in accordance with the invention is shown in FIG. 2. A base member 11, as in the previous example, carries a pair of conductors 12 and 13 which are required to be connected to provide a signal path as in the case of the conductors 2,3 of FIG. 1. For the sake of clarity, however, these conductors are shown arranged side-by-side and extending out of the plane of the drawing in FIG. 2. As before a membrane 14 is provided over the conductor array on the base member 11 and has at least one belled out portion providing a cavity 15 positioned over the contact position of the conductors 12 and 13. Again, as in the case of the former example, a number of cavities 15 may be formed in the membrane 14 by the belling out of various locations of the membrane. A conductive element 16 is provided within the cavity 15 and an actuating plate 17, such as a finger pad, is provided outside the cavity 15. In the present case, however, the cavity 15 is not produced by a simple belling out of a portion in a planar membrane 14, but has by a belling out having a bellows-like peripheral configuration 18 at the point where it joins the plane of the membrane. As shown, this configuration 18 has a single corrugation extending around the recess, and this corrugation has one fold 19 which returns towards the base member 11 and is spaced a short distance away from a further pair of conductors 21 and 22 carried by the base member. The fold 19 carries a conductor 20 on its underside, formed, for example, by a conventional vacuum deposition technique.

It will be appreciated that in use, as the plate 17 is depressed to collapse the cavity 15, the conductor 20 carried on the fold 19 first connects together the two conductors 21 and 22. Then, as the depression of the plate 17 continues, the element 16 is brought into contact with the conductors 12 and 13, so that there is a time relationship between connection of the conductors 21, 22 and 12, 13, produced by the relative spacings between these two pairs of conductors and their corresponding contacts 19 and 16 respectively.

The manner in which the switch is connected in order to overcome the problems referred to earlier, is most simply explained by an example, in which the conductors 12,13,21,22 are connected to a logic network arranged to register the occurrence of an input in response to the depression of the plate 17. The logic network includes a signal register, which may, for example, be a bistable device, and the register is provided with a 'hold' circuit arranged so that activation of the hold circuit, while it cannot itself operate the register, latches the register in its operated condition once it has been externally switched until the hold circuit is deactivated. Thus, the conductors 12 and 13 are connected to operate the register, while the conductors 21 and 22 are connected to activate the hold circuit. If, then the switch is fully operated, the coupling of the conductors 21, 22 by the conductor 20 initially activates the hole circuit, which is ineffective at this time. Continued depression of the switch until the conductive element 16 couples the conductors 12, 13 causes the register to be switched to its operated condition in which it is held by the activation of the hold circuit until the switch has been almost completely released to the point when the fold 19 withdraws the conductor 20 from the conductors 21, 22.

Hence, it will be seen that the initial activation of the hold circuit does not permit the momentary break in the registration of the signal derived from the switch, since as long as the hold circuit is maintained activated by the action of the fold 19 and its conductor 20, then the signal registration, once initiated by the coupling of the conductors 12, 13, will continue uninterrupted. At the same time, because the conductors 20 and 21 are connected only to the hold circuit, they are themselves incapable of generating a spurious signal in the event that the switch is unintentionally only partially operated.

It is to be understood that FIG. 2 shows a construction for the switch that is exemplary only. Thus, the shape of the cavity 15 formed by the recess in the membrane 14 may differ from that shown. For example, the main part of the cavity 15 need not be a simple partial sphere. The upper portion carrying the plate 17 might, for example, actually be concave. Equally the sides of the cavity 15 might slope generally inwards in the shape of a conic section. Again, a single corrugation 18 is shown in the Figure, but it will be realised that a number of corrugations may be provided and the entire cavity may take the form of bellows-like structure. It is essential, however that the shape of the cavity 15 shall be such that a pair of conductive members may be positioned on the part of the membrane forming the cavity so that one is maintained at a closer spacing from a corresponding conductor arrangement than the other, and that in operation, the complete actuation of the switch ensures that the closer-spaced contact arrangement becomes effective before the other and remains effective thenceforward until shortly before the cavity resumes its non-operated condition at the conclusion of its actuation.

It will also be recalled that the conductors 12, 13 were referred to above as extending out of the plane of the drawing, and it will be realised that if such an extension passed beneath the fold 19 of the cavity wall, the conductor 20 could be carried into contact with these conductors. Since it is important that, as described, these conductors should not be coupled before they are contacted by the element 16, it will be clear that such a coupling is prevented by, for example, an insulating layer over the conductors 12, 13 as they pass under the fold 19, or, in the case where they extend only from one side of the cavity 15, by the omission of the conductor 20 from the vicinity of the conductors 12,13.

Equally, of course, the conductors could be provided on the underside of the base member 11 and could then be brought to its upper surface only within the cavity 15.

It is also possible to reduce the member of conductors by using an "earth-operation" mode in which the element 16 and the conductor 20 are connected to an earth connection by, for example a conductor formed inside the cavity 15 and extending out of the cavity to contact an earth conductor (not shown). In this case only one of the conductors 12,13 and one of the conductors 21,22 would be necessary.

It is to be understood that references herein to such expressions as "upper", "lower", and "under" are intended to refer to the disposition of the elements as shown in the drawing and are not to be interpreted as requiring a particular orientation of the switch assembly when in use.

It will also be realised that a number of circuits may be switched by the provision of a corresponding number of conducting elements within the cavity and that the relative timings of their switching may be regulated by their respective positions in the cavity and/or by the precise shaping of the cavity.

I claim:

1. A switch assembly including a base member, at least one pair of conductors provided upon the base member and which are to be electrically connected, an elastomeric membrane extending over the base member, the membrane having at least one portion belled outwardly away from the base member to define a cavity beneath the membrane and being so positioned as to overly at least two separate pairs of conductors to be electrically connected, each said belled out portion of the membrane having a circumscribing region of such characteristics that on exerting pressure on the portion to collapse said portion towards the base member, said circumscribing region is first to collapse, each said portion also including first and second conductive contactor elements positioned as to be electrically connectable with the first and second pairs of the electrical conductor pairs and so located relative to the circumscribing region that on exerting pressure upon the membrane to collapse said portion towards the base member, said first and second conductive contactor contact elements are caused successively to contact the associated first and second pairs of conductors.

2. A switch assembly as claimed in claim 1 in which the first conductive contact comprises a ring-like member.

* * * * *